US006092662A

United States Patent [19]

Frederick, Jr.

[11] Patent Number: 6,092,662

[45] Date of Patent: Jul. 25, 2000

[54] OBJECT STORAGE AND SELECTION SYSTEM

[75] Inventor: Anthony J. Frederick, Jr., Bedford, N.H.

[73] Assignee: Frederickseal, Inc, Manchester, N.H.

[21] Appl. No.: 09/228,911

[22] Filed: Jan. 11, 1999

[51] Int. Cl.[7] ..... B65D 69/00

[52] U.S. Cl. ..... 206/582; 206/303; 206/459.5

[58] Field of Search ..... 206/459.5, 223, 206/303, 445, 582

[56] References Cited

U.S. PATENT DOCUMENTS

| | | | |
|---|---|---|---|
| 4,976,351 | 12/1990 | Mangini et al. | 206/459.5 |
| 5,427,743 | 6/1995 | Markin | 206/459.5 |
| 5,482,159 | 1/1996 | Roraback, Jr. et al. | 206/459.5 |

OTHER PUBLICATIONS frederickseal, inc., Catalog, Feb. 1999, Copyright 1999.

*Primary Examiner*—Jacob K. Ackun
*Attorney, Agent, or Firm*—Bourque & Associates, P.A.

[57] ABSTRACT

An object storage, organization and selection system which is used to store and organize objects, such as o-rings, to facilitate selection of the objects. The system includes a tool kit having tools used to extract old objects, to select objects, and to install the objects. The system also includes a plurality of resealable storage containers for containing the objects. Each of these resealable storage containers includes indicia for indicating one or more characteristics of the objects contained in the resealable storage container, such as the size and type of o-ring stored in the resealable storage container. The system further includes a portable organizing container, such as a box, for containing and organizing the resealable storage containers. The portable organizing container includes one or more data tables containing data pertaining to the selection of objects. The portable organizing container further includes a marking system for monitoring the objects contained in the resealable storage containers within the organizing container.

20 Claims, 2 Drawing Sheets

26

O-RING SECURITY SYSTEM ™

ARP Dash # 326 Nom. Size 1 5/8 x 2 x 3/16 frederickseal reorder # BR326 Customer Part # _____

Min. Stock _____ Reorder Quantity _____

Compound BUNA-N Application _____

NEVER RUN OUT
NEVER TAKE INVENTORY
FOLLOW THE SYSTEM!

Step #1: Refill O-Ring kit or supply part.
Step #2: When bag is at a minimum, call in reorder 800/258-3017 (Qty = 12,25,50,100 per package).
Step #3: Restock system bag with fresh supply.

- O-Ring Kits
- Back-up Kits
- O-Ring Guage Cone
- O-Ring Adhesives
- O-Ring Lubricants
- O-Ring Extractor Tools
- O-Ring Splicing Kits
- O-Ring Elastomer Tester

O-RING ACCESSORIES

24

FIG. 2

OBJECT STORAGE AND SELECTION SYSTEM

FIELD OF THE INVENTION

The present invention relates to a storage system for a large number of small objects and in particular, to a storage, organization, and selection system for a large number of small objects such as o-rings.

BACKGROUND

Small objects such as screws, bolts, washers and o-rings are an essential part of keeping machinery running and repaired. O-rings, for example, frequently consume a very large and disproportionate amount of space relative to their value. Furthermore, disorganized storage of the o-rings frequently requires significant time and effort to find the needed size and compound. Machinery downtime and lost production are a direct result of the usual searches for proper o-rings. For example, lost repair labor is endemic as a result of regular and frequent searches for o-rings. Installation of mis-identified o-rings cause untold machinery failure, loss of production and occasionally loss of human life.

Because o-rings possess a multitude of attributes, not all of which may be critical to a specific sealing application, there is a great deal of confusion surrounding the process for selecting proper o-rings. Factors that are considered in the selection process include size, application, and elastomer composition of o-rings. The size characteristics of an o-ring include nominal size v. actual size, inside diameter (ID) and cross section (c/s) or wall thickness of the o-ring.

Application characteristics of an o-ring include matching the use of the o-ring with the most favorable, desired or required elastomer characteristics and composition. Uses include, for example, use as a gasket (static seal), use as a shaft seal (dynamic seal), use as a reciprocating seal (dynamic seal), and use as a hydraulic seal (high pressure seal).

Elastomer composition characteristics of an o-ring determine other attributes of the o-ring. The attributes include, for example, durometer (shore "A" scale for elastomer hardness), temperature (high and low limits), chemical resistivity to product and cleaning solutions, abrasion resistance to sliding or turning action, and compression set resistance (recovery from load deformation and/or temperature).

Another issue that is considered in the selection process is the environment and space in which o-rings are used. For example, edges must be radiused, clearance must be within tolerances, the space must be checked for burrs, dings, corrosion and any space non-conformance.

A further issue that is considered is the storage of o-rings to keep the o-rings protected. Elastomeric o-rings deteriorate more rapidly when exposed to daylight (UV). Additionally, they outgas (give off an odor) when not enclosed in an airtight storage container. Shop grime also shortens the functional life of o-rings. Elastomers have various shelf lives, but all deteriorate with time.

Finally, a further issue that is considered is identification and organization of o-rings. The United States managed to convene a large body of design engineers, and they agreed to a uniform system of identifying and organizing o-rings by assigning a three-digit number to each inside diameter (ID) permutated by each cross-section (c/s). This system is known as Aerospace Recommended Practice (APP) Universal Dash Series, and more recently is simply known as the AS (Aerospace Standard) 568A (Amended) published by SAE (Society of Automotive Engineers).

O-rings and the grooves they fit into vary by thousandths of an inch in size depending on their application. There are five (5) standard cross sections, one hundred and nineteen (119) inside diameters, and three hundred and forty-nine (349) o-ring size (ID×c/s) combinations. O-rings are ordered according to a "nominal size" of the o-ring. However, when measured, the "actual size" has a smaller inside diameter (ID) and the cross section (c/s) is larger than the "nominal size". For example, 1" nominal inside diameter (ID) of an o-ring would actually measure 0.984", and ⅛" nominal cross section (C/S) would actually measure 0.139". These differences provide the "squeeze" necessary for an o-ring to "work" properly.

In the past, o-rings have been organized in a kit with 30 sizes divided into 4 cross sections 1/16", 3/32", ⅛" and 3/16". The method of organization in the prior kit often provided as few as 3 inside diameter (ID) sizes having a 3/16" cross section size to as many as 13 ID sizes having the ⅛" cross section size. Although the prior o-ring kits provided a useful way of organizing o-rings, the choices of o-rings were extremely limited and the kit frequently did not have the o-ring needed for a particular application. The prior kits also did not have sufficient safe-guards to prevent an o-ring stock-out, nor did they have tools and information needed to identify, select and install the o-rings.

Accordingly, what is needed is an object storage, organization and selection system which provides the maximum choices in the minimum amount of space, which can stratify and organize o-rings so as to relieve anxiety and stress about o-rings and o-ring selection, and which makes the entire process concerning o-ring selection and storage more user-friendly.

SUMMARY OF THE INVENTION

The present invention features an object storage, organization and selection system for use with objects, such as o-rings, having one or more predetermined characteristics. The system includes a plurality of resealable storage containers for receiving the objects, and a portable organizing container for receiving and organizing the resealable storage containers. Each resealable storage container includes indicia for specifying the characteristic(s) of the object(s) in the resealable storage container. Each organizing container includes at least one data table containing data pertaining to use of the objects. The organizing container also preferably includes a marking system for recording and tracking the contents of the organizing container.

According to the preferred embodiment, the system further includes a tool kit containing tools for use with the objects. According to one embodiment, the objects include o-rings and the indicia on each of the resealable storage containers includes sizes of the inside diameter and cross-section of the o-rings in the resealable storage container. In this embodiment, the tool kit contains o-ring tools including, but not limited to, o-ring extractor tools, an o-ring gauge cone for gauging the inside diameter and cross-section of an o-ring, and an o-ring elastomer resiliency tester, which helps define the o-ring compound.

The present invention also features a method for storing, organizing and selecting objects. The method comprises the steps of preparing a plurality of resealable storage containers for receiving the objects; distributing the objects according to at least one predetermined characteristic of the objects, whereby the objects stored in each of the plurality of resealable storage containers have the same predetermined characteristic(s); marking indicia including the predetermined characteristic of the objects on each of the resealable storage containers; organizing the plurality of resealable storage containers in an organizing container according to the indicia; and marking contents of the organizing container on at least one side of the organizing container.

The method further includes the steps of: removing an old o-ring; selecting a new o-ring having an appropriate predetermined characteristic using the indicia on the plurality of resealable containers; and installing the new o-ring using o-ring tools contained in the organizing container. One example of the method further includes monitoring a quantity of the objects in each of the plurality of resealable storage containers; and reordering the objects when the quantity is less than a predetermined reorder quantity.

DESCRIPTION OF THE DRAWINGS

FIG. 2 is an illustration of indicia on a resealable storage container used in the system of the present invention.

DESCRIPTION OF THE INVENTION

Figure 1:
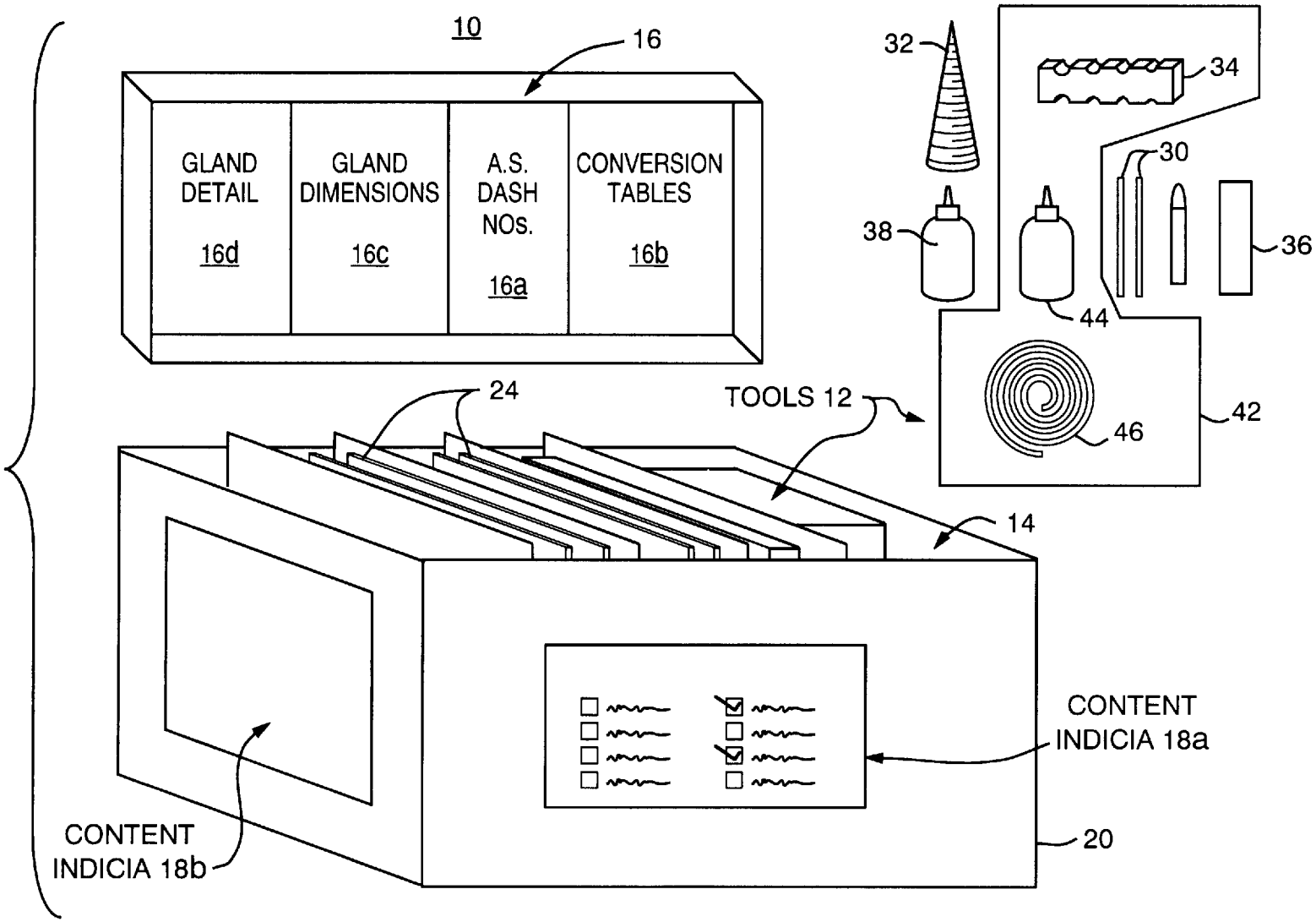
FIG. 1 is a schematic illustration of the object storage, organization, and selection system, according to the present invention.

The object storage, organization, and selection system 10, FIG. 1, according to the present invention, is used for the storage, organization, and selection of objects, such as o-rings. The object storage and selection system 10 organizes the objects by various physical characteristics or attributes of the objects. O-rings, for example, can be organized according to elastomer composition, cross section, and inside diameter. Although the exemplary embodiment of the present invention is used for the storage, organization, and selection of o-rings, the present invention contemplates use with other light weight, discrete and multiple sized items, such as teflon back up rings, quad rings, and hydraulic seals, washers or fasteners.

The object storage, organization, and selection system 10 includes an organizing container 20, such as a plastic box. The organizing container 20 contains one or more tools 12 in a tool kit or resource center 14 and contains a plurality of resealable storage containers 24, such as plastic bags, for receiving the o-rings or other objects and for indicating the characteristics or attributes of the o-rings or objects received therein. The organizing container box 20 is preferably made of a lightweight durable material, such as corrugated plastic, that prevents the progressive deteriorative effect of daylight (UV) on elastomers. The storage container 20 preferably has a cover 17 made of the same material and is compact enough to be completely portable. The preferred embodiment of the organizing container 20 has a size of approximately 30 inches long by 14 inches wide by 12 inches in height. Such a portability of the object storage, organization, and selection system eliminates wasted trips from the job site to the stockroom for o-rings.

The object storage and selection system 10 includes data tables or charts 16, for example, printed on both the inside (not shown) and the outside of the cover 17. In one example, the tables or charts 16 include, but are not limited to, a reference table 16*a* with o-ring dash numbers with markings to indicate stocked items, a conversion table 16*b* with a cross-reference to metric sizes, and o-ring groove design charts showing gland dimensions 16*c* and gland details 16*d*. By using such tables or charts 16, no prior knowledge of o-rings is needed to select the appropriate o-rings.

The object storage and selection system 10 further includes an external marking system 18, for example, on each of the four sides of organizing container 20 (only two sides 18*a*, 18*b* are shown in FIG. 1, but the other two sides are generally identical). The external marking systems 18 are for recording information about the contents of the object storage and selection system 10, such as the kind of elastomers and type of seal so as to speed selection decisions.

The tool kit or resource center 14 generally stores tools 12 used to extract, measure and install the objects. In the case of o-rings, for example, the tools 12 include o-ring extractor tools 30, an o-ring inside diameter (ID) and cross section (c/s) gauge cone 32, a cutting jig for fabricating spliced o-rings, metric cross-sectional grooves 34 for positively separating "inch" o-rings from metric o-rings, an o-ring elastomer resiliency tester 36, and silicone lubricant 38. Such tools are used to extract an old o-ring, measure it for inside diameter (ID) and cross section (c/s) size, then test the new o-ring for the correct elastomer and lubricate the replacement o-ring properly before installing it, all within a few minutes.

The special o-ring extractor tools 30 in the tool kit 12, are typically made of bronze to help eliminate damage to the o-ring groove during o-ring extraction. The metric grooves 34 and o-ring gauge cone 32 facilitate selection of replacements for used o-rings by performing a cross section measurement (i.e., placing o-ring in groove) and an inside diameter measurement (placing o-ring on the cone). Positive identification by inside diameter (ID) and cross section (C/S) of the o-rings can be ascertained nearly instantly so that the user can be sure that the correct size and elastomer compound is being selected, ordered, inventoried, or installed. The silicone lubricant 38 provides pure silicone gel in spouted bottles by which clean lubricant is available every time for each o-ring installed.

Other tools 12 include a system bag marker 40 for marking the resealable storage containers (or bags) 24, an o-ring splicing kit 42 which includes an elastomer specific adhesive 44, cutting jig 34, and o-ring cord material 46 which allows o-rings of various combinations of cross section (c/s) and inside diameter (ID) to be fabricated on the job site for sizes of o-rings which are needed and not readily available.

One example of the resealable storage containers 24, FIG. 2, includes self-closing (e.g., resealable type) plastic bags as is well known in the art and available, for example, under the trademark ZIP-LOCK®. Resealable storage containers 24, such as plastic bags, prevent o-rings from outgasing (i.e. giving off an "odor") and eliminate foreign and/or airborne debris and/or gases, such as oxygen, from coating and/or deteriorating exposed o-rings. Each of the resealable storage containers 24 has indicia 26 on its surface for recording the predetermined characteristic(s) and other information pertaining to the o-rings or other objects contained in the resealable storage containers 24.

In the exemplary embodiment, the indicia 26 includes, but is not limited to, the AS or ARP dash number, reorder number, minimum stock quantity, elastomeric compound, nominal size, customer part number, reorder quantity, and application (use). The marker 40 in the tool kit 14 is used for marking such characteristics or information, so that every storage container 24 can have up-dated indicia 26. The indicia 26 informs the user of the type of o-rings in the storage container 24, what they can be used for, and when they should be reordered. For example, the o-ring minimum quantity indicates a minimum supply that triggers a reorder of o-rings.

Accordingly, the present invention covers every standard size o-ring in the AS568A Universal Dash Series having cross-section sizes of 1/16", 3/32", or 1/8" and inside diameter sizes from 1/8" ID to 1¾" ID. This system organizes over 1600 o-rings into over 77 different sizes within a space of less than one cubic foot, allowing a specific o-ring to be positively identified within seconds. The present invention can prevent an out-of-stock condition by triggering the re-ordering of o-rings at a pre-determined minimum stock amount and can eliminate wasted trips from the job site to the stockroom for o-rings by positively identifying the proper size and compound of the o-rings. Further, since all objects (o-rings) are stored in a single space (storage box) which is compact enough to be portable, there can be no "secret stashes" of the small objects (o-rings) throughout the plant. Moreover, the o-rings can be easily installed using information and tools provided with the system.

Modifications and substitutions by one of ordinary skill in the art are considered to be within the scope of the present invention.

What is claimed is:

1. An object storage, organization and selection system comprising:

a plurality of resealable storage containers containing a plurality of objects, said plurality of objects having at least one predetermined characteristic, each of said plurality of resealable storage containers including indicia for specifying said at least one predetermined characteristic of said objects in each of said plurality of resealable storage containers;

a tool kit containing tools for use with said plurality of objects; and a portable organizing container for receiving and organizing said plurality of resealable storage containers, said portable organizing container including at least one data table containing data pertaining to the use of said objects.

2. The object storage, organization and selection system of claim 1, wherein said organizing container has at least one marking system, for recording and tracking contents of said organizing container.

3. The object storage, organization and selection system of claim 1, wherein said organizing container organizes said plurality of resealable storage containers according to said indicia on each of said plurality of resealable storage containers.

4. The object storage, organization and selection system of claim 1, wherein said plurality of objects in said plurality of resealable storage containers include o-rings.

5. The object storage, organization and selection system of claim 4, wherein said indicia on each of said plurality of resealable storage containers includes sizes of inside diameter and cross-section of said o-rings in each of said plurality of resealable storage containers.

6. The object storage, organization and selection system of claim 5, wherein said tool kit includes o-ring tools for use with said o-rings.

7. The object storage, organization and selection system of claim 6, wherein said o-ring tools in said tool kit include o-ring extractor tools.

8. The object storage, organization and selection system of claim 6, wherein said o-ring tools in said tool kit include a gauge cone for gauging inside diameter and cross-section of an o-ring.

9. The object storage, organization and selection system of claim 6, wherein said o-ring tools in said tool kit include an o-ring elastomer composition tester.

10. An o-ring storage, organization and selection system comprising:

a plurality of resealable storage containers each containing a plurality of o-rings having at least one predetermined characteristic, each of said plurality of resealable storage containers including indicia for recording said at least one predetermined characteristic of said plurality of o-rings in each of said plurality of resealable storage containers;

an organizing container for receiving and organizing said plurality of resealable storage containers according to said indicia of each of said plurality of resealable storage containers; and a tool kit for containing o-ring tools for use with said objects.

11. The o-ring storage, organization and selection system of claim 10, wherein said organizing container has at least one marking system, for recording contents of said organizing container.

12. The o-ring storage, organization and selection system of claim 10, wherein said indicia of each of said plurality of resealable storage containers includes sizes of inside diameter and cross section of said o-rings in each of said plurality of resealable storage containers.

13. The o-ring storage, organization and selection system of claim 11, wherein said organizing container includes at least one data table containing data pertaining to o-rings.

14. The o-ring storage, organization and selection system of claim 10, wherein said o-ring tools include at least one of: an o-ring extractor tool; an o-ring measuring tool; an o-ring lubricant; a marker; a resealable bag; an o-ring splice kit including an o-ring cutting jig, an elastomer specific adhesive, at least one o-ring cutter and a plurality of o-ring cords; and an o-ring resiliency tester.

15. The o-ring storage, organization and selection system of claim 10, wherein said organizing container is made of a material that prevents the progressive deteriorative effect of light on elastomers.

16. The o-ring storage, organization and selection system of claim 15, wherein said material is a corrugated plastic.

17. A method for sto-ring, organizing and selecting objects comprising the steps of:

preparing a plurality of resealable storage containers for receiving said objects;

sorting said objects according to at least one predetermined characteristic of said objects;

storing said sorted objects in said plurality of resealable storage containers, whereby said objects stored in each of said plurality of resealable storage containers have the same said at least one predetermined characteristic;

marking indicia on each of said plurality of resealable storage containers, said indicia including said at least one predetermined characteristic of said objects;

organizing said plurality of resealable storage containers in an organizing container according to said indicia;

selecting tools for use with said plurality of objects;

storing said selected tools in said organizing container; and marking contents of said organizing container on at least one side of said organizing container.

18. The method of claim 17, wherein said steps of sorting and storing said objects in said plurality of resealable storage containers comprise sorting o-rings and storing said sorted o-rings in said plurality of resealable storage containers.

19. The method of claim 18, further including the steps of:

removing an old o-ring;

selecting a new o-ring having an appropriate said at least one predetermined characteristic using said indicia on said plurality of resealable containers; and installing said new o-ring.

20. The method of claim 19 further including the steps of:

monitoring a quantity of said objects in each of said plurality of resealable storage containers; and reordering said objects when said quantity is less than a predetermined reorder quantity.

* * * * *